US009707981B2

(12) United States Patent
Wang et al.

(10) Patent No.: US 9,707,981 B2
(45) Date of Patent: Jul. 18, 2017

(54) CAR-COUPLER BUFFER AND RAIL WAY CAR

(71) Applicants: Qiqihar Railway Rolling Stock Co., Ltd. Dalian R&D Centre, Liaoning (CN); Qiqihar Railway Rolling Stock Co., Ltd., Heilongjiang (CN)

(72) Inventors: Xiaolong Wang, Heilongjiang (CN); Yuebin Yu, Heilongjiang (CN); Haibin Hu, Heilongjiang (CN); Long Chen, Heilongjiang (CN); Changchun Wang, Heilongjiang (CN); Qingmin Meng, Heilongjiang (CN)

(73) Assignees: CRRC Qiqihar Rolling Stock Co., Ltd. Dalian Research & Development Center (CN); CRRC Qiqihar Rolling Stock Co., Ltd. (CN)

( * ) Notice: Subject to any disclaimer, the term of this patent is extended or adjusted under 35 U.S.C. 154(b) by 104 days.

(21) Appl. No.: 14/648,085

(22) PCT Filed: Oct. 20, 2014

(86) PCT No.: PCT/CN2014/088917
§ 371 (c)(1),
(2) Date: May 28, 2015

(87) PCT Pub. No.: WO2015/058662
PCT Pub. Date: Apr. 30, 2015

(65) Prior Publication Data

US 2015/0307115 A1 Oct. 29, 2015

(30) Foreign Application Priority Data

Oct. 25, 2013 (CN) ..... 2013 1 0518110
Oct. 25, 2013 (CN) ..... 2013 1 0518589
(Continued)

(51) Int. Cl.
*B61G 11/14* (2006.01)
*B61G 9/06* (2006.01)

(52) U.S. Cl.
CPC ..... *B61G 11/14* (2013.01); *B61G 9/06* (2013.01)

(58) Field of Classification Search
CPC ... B61G 9/06; B61G 9/24; B61G 7/10; B61G 9/04; B61G 9/10; B61G 9/22; B61G 11/00; B61G 9/14; B61G 11/14
See application file for complete search history.

(56) References Cited

U.S. PATENT DOCUMENTS 1,062,312 A 5/1913 Watson
2,588,488 A * 3/1952 Dath ..... B61G 9/10 105/198.7
(Continued)

FOREIGN PATENT DOCUMENTS

CN 2571635 9/2003
CN 201410961 2/2010
(Continued)

OTHER PUBLICATIONS

Chinese Patent Application No. 201310518589.X: 3rd Office Action dated Jun. 30, 2016, with English summary, 9 pages.
(Continued)

*Primary Examiner* — Mark Le
(74) *Attorney, Agent, or Firm* — Baker & Hostetler LLP

(57) ABSTRACT

A coupler buffer is provided that includes a coupler yoke for connection to a coupler, a front stop body for mounting to a vehicle body, a first elastic element, wherein a rear end thereof abuts against the coupler yoke and a front end thereof abuts against the front stop body, a casing arranged at a rear end of the coupler yoke, wherein a rear end of the casing is configured to be connected to the vehicle body, and
(Continued)

the casing is connected with the coupler yoke via a connecting shaft, and the coupler yoke is movable along an axial direction of the connecting shaft, and a second elastic element arranged between the casing and the coupler yoke, wherein even when a vehicle body suffers a traction force or a compression force, the coupler buffer may function well.

17 Claims, 7 Drawing Sheets

(30) Foreign Application Priority Data

| | | |
|---|---|---|
| Oct. 25, 2013 | (CN) | 2013 1 0521114 |
| Oct. 25, 2013 | (CN) | 2013 1 0521142 |
| Oct. 25, 2013 | (CN) | 2013 1 0521145 |

(56) References Cited

U.S. PATENT DOCUMENTS

| | | | | |
|---|---|---|---|---|
| 2,635,766 | A | 4/1953 | Willison | |
| 2,763,379 | A | 9/1956 | Danielson | |
| 2,854,149 | A * | 9/1958 | Withall | B61G 9/14 213/45 |
| 3,838,778 | A | 10/1974 | Appleton | |
| 4,428,489 | A * | 1/1984 | Hanula | B61G 3/04 213/50 |
| 2002/0070189 | A1 | 6/2002 | Barker et al. | |
| 2008/0011700 | A1 * | 1/2008 | Brough | B61G 9/24 213/75 R |
| 2014/0144863 | A1 | 5/2014 | Sagawa et al. | |

FOREIGN PATENT DOCUMENTS

| | | | |
|---|---|---|---|
| CN | 202320351 | | 7/2012 |
| CN | 202449006 | | 9/2012 |
| CN | 102717813 | | 10/2012 |
| CN | 202987188 | | 6/2013 |
| CN | 103237710 | | 8/2013 |
| CN | 103523042 | | 1/2014 |
| CN | 103523043 | | 1/2014 |
| CN | 103523044 | | 1/2014 |
| CN | 103523046 | | 1/2014 |
| CN | 103523048 | | 1/2014 |
| GB | 606517 | | 8/1948 |
| GB | 752962 | A | 7/1956 |
| WO | WO 2012/039459 | * | 3/2012 |

OTHER PUBLICATIONS

Chinese Patent Application No. 201310518589.X: 2nd Office Action dated Mar. 2, 2016, with English summary, 8 pages.
Australian Patent Application No. 2014339562: Patent Examination Report No. 1 dated Mar. 22, 2016, 3 pages.
Chinese Application No. 201310518110.2: Office Action dated Jun. 8, 2015, 8 pages.
Chinese Application No. 201310518589.X: Office Action dated Jul. 3, 2015, 8 pages.
Chinese Application No. 201310521114.6: Office Action dated Jun. 9, 2015, 8 pages.
Chinese Application No. 201310521142.8: Office Action dated Jun. 24, 2015, 8 pages.
Chinese Application No. 201310521145.1: Office Action dated Jul. 3, 2015, 7 pages.

* cited by examiner

CAR-COUPLER BUFFER AND RAIL WAY CAR

CROSS-REFERENCE TO RELATED APPLICATIONS

This application is the National Stage of International Application No. PCT/CN2014/088917, filed Oct. 20, 2014, which claims the benefit of Chinese application number 201310518110.2, filed Oct. 25, 2013; Chinese application number 201310518589.X, filed Oct. 25, 2013; Chinese application number 201310521114.6, filed Oct. 25, 2013; Chinese application number 201310521142.8, filed Oct. 25, 2013; and Chinese application number 201310521145.1, filed Oct. 25, 2013, the disclosures of which are incorporated herein by reference in their entireties.

The present application claims the benefit of priorities to the following five Chinese patent applications, and the entire disclosures of which are incorporated herein by reference, and the five Chinese patent applications are as follows:

Chinese patent application No. 201310521145.1, titled "COUPLER BUFFER", filed with the Chinese State Intellectual Property Office on Oct. 25, 2013;

Chinese patent application No. 201310518589.X, titled "COUPLER BUFFER AND REINFORCING PLATE FOR TENSILE OVERLOAD PROTECTION THEREOF", filed with the Chinese State Intellectual Property Office on Oct. 25, 2013;

Chinese patent application No. 201310521114.6, titled "COUPLER BUFFER AND CASING FOR COMPRESSION OVERLOAD PROTECTION THEREOF", filed with the Chinese State Intellectual Property Office on Oct. 25, 2013;

Chinese patent application No. 201310521142.8, titled "COUPLER BUFFER AND ROTATING SLEEVE THEREOF", filed with the Chinese State Intellectual Property Office on Oct. 25, 2013; and Chinese patent application No. 201310518110.2, titled "RAILWAY VECHILE", filed with the Chinese State Intellectual Property Office on Oct. 25, 2013.

TECHNICAL FIELD

The present application relates to the technical field of rail transit, and particularly to a coupler buffer and a railway vehicle having the coupler buffer.

BACKGROUND

A coupler is one of the important parts of a railway vehicle, and two cars of the railway vehicle are connected with each other via the coupler. For avoiding a rigid impact between two couplers in the accelerating or decelerating process of the cars, a coupler buffer is mounted to the car according to the conventional technology. The coupler is connected to the car via the coupler buffer which provides buffering.

The coupler buffer in the conventional technology generally is a one-way buffer structure. Reference is made to FIG. 1, which is a schematic view showing the structure of a coupler buffer in the conventional technology.

A conventional coupler buffer includes a follower 2, an elastic component 3, a rear follower stop 4, a coupler yoke 5 and a front follower stop 6. In a case that a car suffers a compression load, for example when a train decelerates, a longitudinal load of the train is transmitted to the follower 2, then to the buffer 3, and finally to the rear follower stop 4 from a coupler 1. The buffer component can buffer the external impact, thereby protecting components which directly suffer a rigid load, such as a coupler body, a coupler knuckle, a coupler yoke, a vehicle body, and cargoes, etc.

In a case that the car suffers a tensile load, for example, when the train accelerates, the longitudinal load of the train is transmitted to the coupler yoke 5, then to the buffer 3, and then to the follower 2, and finally to the front follower stop 6 from the coupler 1. Since the buffer 3 currently used is a dry friction buffer and the quasi-static rigidity of the buffer is great, the buffer 3 cannot function well when a traction force is small, and the coupler body, and the coupler knuckle, the coupler yoke suffer the rigid load directly, thus aggravating the fatigue damage.

Furthermore, the buffer 3 is generally an elastic component. In a case that the vehicle suffers a tensile load, the elastic component 3 and the follower 2 are compressed inbetween the coupler yoke 5 and the front follower stop 6. Thus, when the tensile load suffered by the vehicle excesses the ultimate load of the elastic buffer, the elastic component 3 is apt to be damaged due to being over compressed.

In addition, in a case that the compression load suffered by the vehicle excesses the ultimate load of the buffer, the follower would be further compressed by the coupler until the follower comes into contact with a casing of the buffer. The casing of the buffer plays a role of overload protection, thus avoiding the damage to the coupler door due to a direct contacting of the coupler shoulder and the coupler door for an excessive compression of the buffer in the compression stroke. However, since the compression load is excessive, the casing of the buffer in the conventional technology is apt to be damaged.

Reference is further made to FIG. 2, which is a schematic view showing the structure of another coupler buffer in the conventional technology.

In the coupler buffer in the conventional technology, the coupler 1 of the coupler buffer is connected in the coupler yoke 3 via a coupler tail pin 2. A rotating sleeve 4 is provided between the coupler tail pin 2 and the coupler yoke 3, and is rotatably arranged in the coupler yoke 3. Thus, the coupler 1 can be rotated about its axis via the rotating sleeve 4.

However, in a case that the vehicle is under a compression force, for example, when the railway vehicle accelerates, the rotating sleeve 4 is moved in the direction of the axial compression force under an axial compression force by the coupler tail pin 2. The contact between the coupler yoke 3 and the rotating sleeve 4 is an arc surface contact, and the friction between the coupler yoke 3 and the rotating sleeve 4 is relatively large, which is apt to cause a friction problem between the coupler yoke 3 and the rotating sleeve 4.

Therefore, a significant technical issue to be solved by the skilled person in the art is to provide a coupler buffer which may function well when a vehicle suffers a tensile load, thus avoiding a coupler body, a coupler knuckle and a coupler yoke of the vehicle directly suffering a rigid load, not aggravating the fatigue damage.

SUMMARY

A coupler buffer is provided according to the present application, which may provide bidirectional buffering. Regardless of a vehicle body suffers a traction force or a compression force, the coupler buffer may function well and further avoid a problem of aggravated fatigue damage due to a rigid load directly applied on a coupler body, a coupler knuckle and the coupler yoke of the vehicle.

A coupler buffer according to the present application, includes:

a coupler yoke for being connected to a coupler, a front stop body for being mounted to a vehicle body, a first elastic element, wherein a rear end of the first elastic element abuts against the coupler yoke and a front end first elastic element abuts against the front stop body, and in a case that the vehicle body suffers a traction force, the first elastic element is compressed under force, a casing arranged at a rear end of the coupler yoke, wherein a rear end of the casing is configured to be connected to the vehicle body, and the casing is connected to the coupler yoke via a connecting shaft, and the coupler yoke is movable along an axial direction of the connecting shaft, and a second elastic element arranged between the casing and the coupler yoke, wherein in a case that the vehicle body suffers a compression force, the second elastic element is compressed under force.

Preferably, a follower is provided in the coupler yoke, and a front end of the first elastic element abuts against the front stop body via the follower, and the follower abuts against a rear end of the coupler.

Preferably, the follower, the first elastic element, the coupler yoke, the second elastic element and the casing are connected in series on the connecting shaft.

Preferably, the follower is provided with an arched groove on a surface corresponding to the coupler, and the arched groove is matched with a spherical surface end of the coupler.

Preferably, the coupler buffer further includes a rear stop body which is mounted to the vehicle body and abuts against the rear end of the casing.

Preferably, each of the first elastic element and the second elastic element includes multilayer of overlapped elastomers.

Preferably, each of the overlapped elastomers is a rubber sheet.

Preferably, the connecting shaft extends out of the rear end of the casing, and the extended portion is provided with threads, and the connecting shaft is connected to the coupler yoke and the casing.

Preferably, a rotating sleeve is sleeved on a portion, inserting into the coupler yoke, of the coupler, and the rotating sleeve is rotatably fixed into the coupler yoke.

Preferably, the coupler buffer further includes a reinforcing plate for a tensile overload protection, wherein multiple the reinforcing plates is provided, and each of the reinforcing plates is inserted into the first elastic component in a direction perpendicular to the direction that the first elastic component is compressed, the reinforcing plate comprises a main body portion inserted into the first elastic component and a protrusion which is arranged at an edge of the main body portion and protrudes out of the main body portion, and the protrusion and the main body portion form a groove for accommodating the first elastic component.

Preferably, the casing is provided for compression overload protection, the casing is a cylindrical structure with an opening provided at one end, and the second elastic component of the coupler buffer is arranged in the casing, and a cross section of the casing has an outer regular hexagonal edge and an inner circular edge.

Preferably, the coupler buffer further includes a rotating sleeve, the rotating sleeve comprises a rotating ring portion configured to be sleeved on an outer periphery of the coupler and a mounting portion for a coupler tail pin which is connected to an end of the rotating ring portion, and an outer surface of the rotating ring portion is a spherical surface.

Preferably, an outer surface of the mounting portion for the coupler tail pin is a cylindrical surface which is matched with an inner side surface of the coupler yoke.

Preferably, the mounting portion for the coupler tail pin includes a first half annular groove matching with one end of the coupler tail pin and a second half annular groove matching with another end of the coupler tail pin.

Preferably, the second haft annular groove is provided with a bottom portion which abuts against the coupler tail pin.

A railway vehicle is further provided according to the present application, which includes the coupler buffer according to any one of the above technical solutions.

The coupler buffer according to the present application includes a coupler yoke, a front stop body, a first elastic element, a casing and a second elastic element. When being in use, a coupler of a vehicle and the coupler yoke of the coupler buffer are connected to each other. The front stop body of the coupler buffer is mounted to a vehicle body. A rear end of the casing is connected to the vehicle body. A rear end of the first elastic element abuts against the coupler yoke, and a front end of the first elastic element abuts against the front stop body. In a case that the vehicle body suffers a traction force, the first elastic element is compressed under force. The casing is arranged at a rear end of the coupler yoke, and the casing and the coupler yoke are connected in series via a connecting shaft, and the coupler yoke is movable along an axial direction of the connecting shaft. The second elastic element is arranged between the casing and the coupler yoke. In a case that the vehicle body suffers a compression force, the second elastic element is compressed under force.

It is to be noted that, spatial terms "front" and "rear" are used for referring to directions under normal mounting conditions of the coupler and the coupler buffer, as well as the coupler buffer and the vehicle body. Specifically, an end relatively close to a coupler head of the coupler is defined as "front", and an end relatively far from the coupler head of the coupler is defined as "rear".

In such an arrangement, in a case that the vehicle body suffers a traction force, the coupler draws the coupler yoke to move forward in an axial direction of the connecting shaft.

Since the rear end of the first elastic element abuts against the coupler yoke and the front end of the first elastic element abuts against the front stop body, the first elastic element is compressed under force by the compression of the coupler yoke, which provides excellent buffering. Meanwhile, the coupler yoke transmits the traction force to the casing via the connecting shaft, and since the rear end of the casing is connected to the vehicle body, the vehicle body is further drawn to move forward.

In a case that the vehicle body suffers a compression force, the coupler transmits the compression force to the coupler yoke, and the coupler yoke transmits the compression force to the casing via the second elastic element, and then the casing transmits the compression force to the vehicle body. At this time, the second elastic element is compressed under force and provides excellent buffering.

In summary, the coupler buffer according to this embodiment of the present application can provide bidirectional buffing. Regardless the vehicle body suffers a traction force or a compression force, the coupler buffer can function well and further avoid a problem of aggravated fatigue damage due to a rigid load directly applied on a coupler body, a coupler knuckle and the coupler yoke 11 of the vehicle.

The coupler buffer according to the present application further includes a reinforcing plate for a tensile overload protection. Multiple reinforcing plates are provided. Each of the reinforcing plates is inserted into the first elastic component in a direction perpendicular to the direction that the first elastic component is compressed. The reinforcing plate includes a main body portion inserted into the first elastic component and a protrusion which is arranged at an edge of the main body portion and protrudes out of the main body portion. The protrusion 10*b* and the main body portion form a groove for accommodating the first elastic component.

In the reinforcing plate for tensile overload protection, the protrusion, which is inserted into the first elastic component, is provided all round the main body portion, thus the protrusions and the main body portion form a groove for accommodating the first elastic component. In a case that the vehicle suffers a tensile force which excesses the ultimate load of the buffer, the first elastic component may be compressed under force. At the same time, the protrusions of adjacent two reinforcing plates would abut against each other, and the first elastic component will not be compressed further, effectively protecting the first elastic component.

The coupler buffer according to the present application further includes a casing for compression overload protection. The casing is a cylindrical structure with an opening provided at one end, and the second elastic component of the coupler buffer is arranged in the casing, and a cross section of the casing has an outer regular hexagonal edge and an inner circular edge. The casing for compression overload protection according to the present application is a cylinder structure which has an opening at one end, and the second elastic element of the buffer may be mounted into the casing via the opening. Since the cross section of the casing has the outer regular hexagonal edge and the inner circular edge, the casing with such a structure is capable of bearing a larger load in an axial direction than a casing having a circular outer edge and a circular inner edge or having a rectangular outer edge and a rectangular inner edge. Thus, when the compression load suffered by the vehicle excesses the ultimate load of the second elastic element, the casing can provide effective protection to the second elastic element therein.

The coupler buffer according to the present application further includes a rotating sleeve. The rotating sleeve includes a rotating ring portion sleeved on an outer periphery of the coupler, and a mounting portion for a coupler tail pin which is connected to an end of the rotating ring portion. An outer surface of the rotating ring portion, i.e., the surface that the rotating sleeve contacts with the coupler yoke, is a spherical surface. In such an arrangement, in the rotating sleeve according to the present application, the coupler is nested in the rotating ring portion. The coupler tail pin, which is inserted into the coupler, is mounted to the mounting portion for the coupler tail pin by a portion protruding out of the coupler, of the coupler tail pin, and is limited by the mounting portion for the coupler tail pin. As the coupler rotates, the coupler tail pin allows the rotating sleeve to be rotated. In a case that the vehicle suffers a compression force, the coupler allows the rotating sleeve to slide in the coupler yoke in an axial direction. Since the outer peripheral surface of the rotating portion 01 in the rotating sleeve according to this embodiment is a spherical surface, the contact between the rotating sleeve and the coupler yoke is a line contact, thereby the friction between the rotating sleeve and the coupler yoke is small, effectively avoiding wear problem of the rotating sleeve and the coupler yoke.

A railway vehicle is further provided according to the present application, and the coupler buffer of the railway vehicle may provide bidirectional buffering. Regardless of a vehicle body suffers a traction force or a compression force, the coupler buffer may function well and further avoid a problem of aggravated fatigue damage due to a rigid load directly applied on a coupler body, a coupler knuckle and the coupler yoke of the vehicle.

BRIEF DESCRIPTION OF THE DRAWINGS

In FIG. 1:

Figure 1:
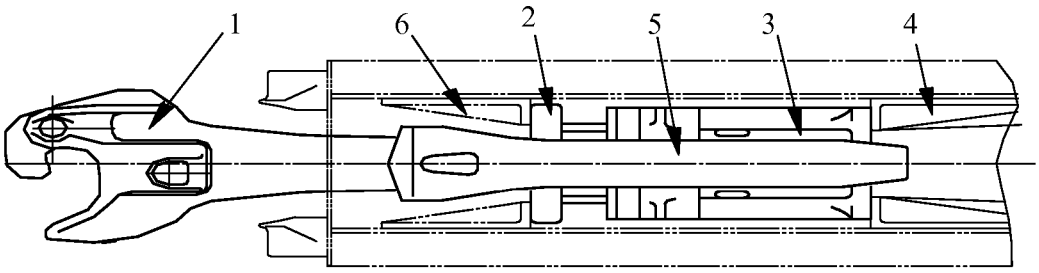
FIG. 1 is a schematic view showing the structure of a coupler buffer in the conventional technology.
Figure 2:
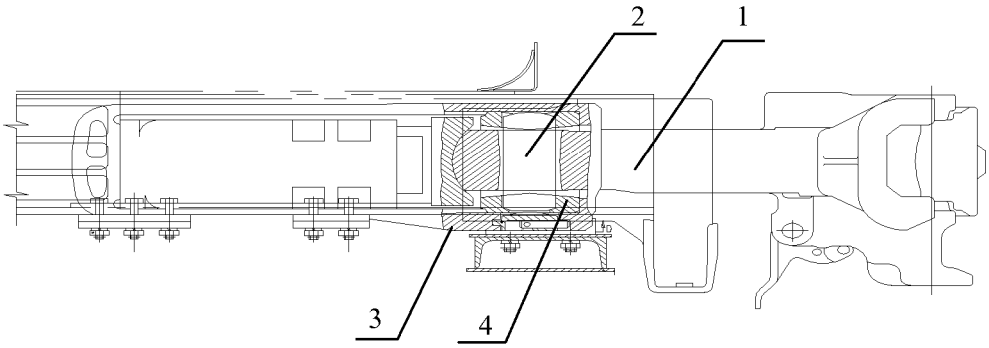
FIG. 2 is a schematic view showing the structure of another coupler buffer in the conventional technology.

| | | | |
|---|---|---|---|
| 1 | coupler, | 2 | follower, |
| 3 | buffer, | 4 | rear follower stop, |
| 5 | coupler yoke, | 6 | front follower stop; |

in FIG. 2:

| | | | |
|---|---|---|---|
| 1 | coupler, | 2 | coupler tail pin, |
| 3 | coupler yoke, | 4 | rotating sleeve; |

in FIGS. 3 to 14:

| | | | |
|---|---|---|---|
| 11 | coupler yoke, | 12 | front stop body, |
| 13 | first elastic element, | 14 | casing, |
| 15 | second elastic element, | 16 | coupler, |
| 17 | connecting shaft, | 18 | follower, |
| 19 | rear stop body, | 20 | rotating sleeve, |

-continued

| | | | |
|---|---|---|---|
| 10 | reinforcing plate, | 10a | main body portion, |
| 10b | protrusion, | 01 | rotating ring portion, |
| 02 | mounting portion for coupler tail pin, | 03 | coupler tail pin, |
| 04 | first half annular groove, | 05 | second half annular groove. |

DETAILED DESCRIPTION

For the skilled person in the art to better understand technical solutions of the present application, the technical solutions in the embodiments of the present application are described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

A coupler buffer is provided according to a first embodiment of the present application, which may provide bidirectional buffering. Regardless of a vehicle body suffers a traction force or a compression force, the coupler buffer may function well and further avoid a problem of aggravated fatigue damage due to a rigid load directly applied on a coupler body, a coupler knuckle and the coupler yoke of the vehicle.

Figure 3:
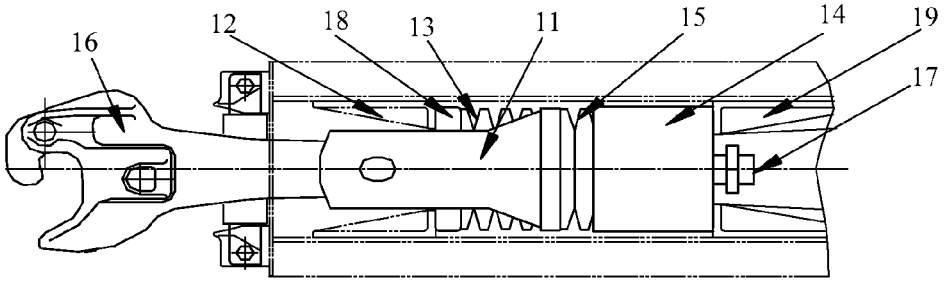
FIG. 3 is a schematic view showing that a coupler buffer, according to a first embodiment of the present application, is connected with a coupler.
Figure 4:
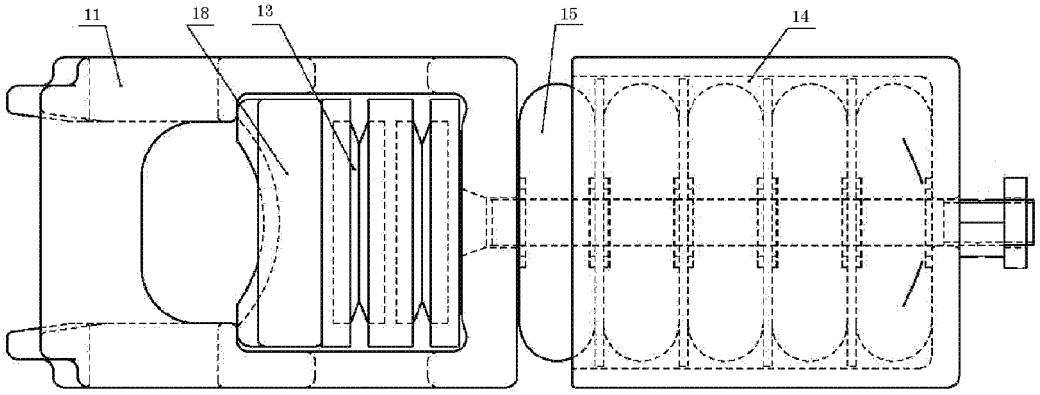
FIG. 4 is a schematic view showing the structure of the coupler buffer according to the first embodiment of the present application.
Figure 5:
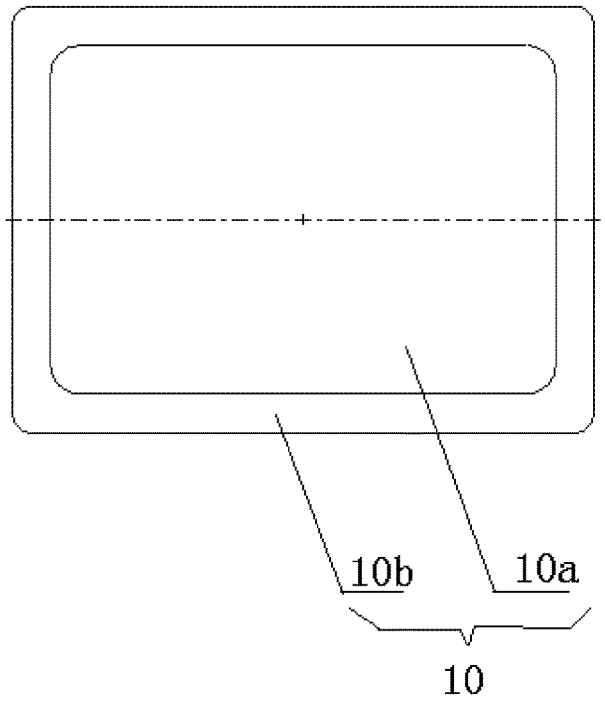
FIG. 5 is top view of a reinforcing plate according to a second embodiment of the present application.

Reference is made to FIGS. 3 and 4, the coupler buffer according to the embodiment includes a coupler yoke 11, a front stop body 12, a first elastic element 13, a casing 14, and a second elastic element 15. When being assembled, a coupler 16 of a vehicle and the coupler yoke 11 of the coupler buffer are connected to each other. The front stop body 12 of the coupler buffer is mounted to a vehicle body. A rear end of the casing 14 is connected to the vehicle body. A rear end of the first elastic element 13 abuts against the coupler yoke 11, and a front end f the first elastic element 13 abuts against the front stop body 12. In a case that the vehicle body suffers a traction force, the first elastic element 13 is compressed under force. The casing 14 is arranged at a rear end of the coupler yoke 11, and the casing 14 and the coupler yoke 11 are connected in series via a connecting shaft 17, and the coupler yoke 11 is movable along an axial direction of the connecting shaft 17. The second elastic element 15 is arranged between the casing 14 and the coupler yoke 11. In a case that the vehicle body suffers a compression force, the second elastic element 15 is compressed under force.

It is to be noted that, spatial terms "front" and "rear" are used for referring to locations under normal mounting conditions of the coupler 16 and the coupler buffer, as well as the coupler buffer and the vehicle body. Specifically, an end relatively close to a coupler head of the coupler 16 is defined as "front", and an end relatively far from the coupler head of the coupler 16 is defined as "rear".

In such an arrangement, in a case that the vehicle body suffers a traction force, the coupler 16 draws the coupler yoke 11 to move forward in an axial direction of the connecting shaft 17. Since the rear end of the first elastic element 13 abuts against the coupler yoke 11 and the front end of the first elastic element 13 abuts against the front stop body 12, the first elastic element 13 is compressed under force by the compression of the coupler yoke 11, which provides excellent buffering. Meanwhile, the coupler yoke 11 transmits the traction force to the casing 14 via the connecting shaft 17, and since the rear end of the casing 14 is connected to the vehicle body, the vehicle body is further drawn to move forward.

In a case that the vehicle body suffers a compression force, the coupler 16 transmits the compression force to the coupler yoke 11, and the coupler yoke 11 transmits the compression force to the casing 14 via the second elastic element 15, and then the casing 14 transmits the compression force to the vehicle body. At this time, the second elastic element 15 is compressed under force and provides excellent buffering.

In summary, the coupler buffer according to this embodiment of the present application can provide bidirectional buffing Regardless the vehicle body suffers a traction force or a compression force, the coupler buffer can function well and further avoid a problem of aggravated fatigue damage due to a rigid load directly applied on a coupler body, a coupler knuckle and the coupler yoke 11 of the vehicle.

In a preferred solution provided in this embodiment, a follower 18 is provided in the coupler yoke 11. A front end of the first elastic element 13 abuts against the front stop body 12 via the follower 18, and the follower 18 abuts against a tail end of the coupler 16.

In a case that the vehicle body suffers a compression force, the coupler 16 directly transmits the compression force to the coupler yoke 11, meanwhile, the tail end of the coupler 16 abuts against the follower 18. The coupler 16 transmits a part of compression force to the follower 18 via the tail end, and the first elastic element 13 is compressed. The first elastic element 13 provides buffering when being compressed under force. The first elastic element 13 transmits the force to the coupler yoke 11, and the coupler yoke 11 then transmits the force to the second elastic element 15, and the second elastic element 15 is compressed under the force and provides buffering. In such an arrangement, in a case that the vehicle body suffers a compression force, the first elastic element 13 and the second elastic element 15 are both compressed, thus provide better buffing.

Furthermore, an arched groove may be provided on the follower 18 at a surface corresponding to the coupler body. The tail end of the coupler body is required to be formed into a spherical surface, which is matched with the arched groove. In such an arrangement, in a case that the coupler body suffers a compression force, if the coupler body rotates with respect to the follower 18, a contact stress between the coupler body and the follower 18 is avoided and wear between the coupler body and the follower 18 is further avoided since the contact surface of the coupler body and the follower 18 is an arch surface and smooth, and the contact area is relatively large.

For increasing the stability of the buffer, the follower 18, the first elastic element 13, the coupler yoke 11, the second elastic element 15, and the casing 14 are connected in series on the connecting shaft 17. It is to be noted that, the follower 18, the first elastic element 13, the coupler yoke 11, the second elastic element 15 are movable along the connecting shaft 17 after being connected on the connecting shaft 17 in series, such that the first elastic element 13 can be compressed by the follower 18, and then the first elastic element 13 is elastically deformed, and the second elastic element 15 can be compressed by the coupler yoke 11 and then the second elastic element 15 is elastically deformed.

In such an arrangement, the follower 18, the first elastic element 13, the coupler yoke 11, the second elastic element 15 and the casing 14 are connected in series via the connecting shaft 17 and integrally formed, thereby improving the assembly reliability of each component.

In another preferred solution according to this embodiment, the coupler buffer may further include a rear stop body 19 which is mounted to the vehicle body and abuts against the rear end of the casing 14.

In such an arrangement, in a case that the vehicle body suffers compression force, the casing 14 abuts against the rear stop body 19 at the rear end of the casing 14, and the compression force is further transmitted to the vehicle body. Since the compression force suffered by the vehicle body is great, the solution according to this embodiment can prevent damage, due to a direct contacting of the casing 14 and the vehicle body, to the vehicle body.

For improving the buffering effect of the first elastic element 13 and the second elastic element 15, each of the first elastic element 13 and the second elastic element 15 includes multilayer overlapped elastomers. In such an arrangement, each of the first elastic element 13 and the second elastic element 15 is configured into a multilayer structure, which can effectively improve the buffing effect of the first elastic element 13 and the second elastic element 15.

Each of the elastomers may be a rubber sheet, and each of the first elastic element 13 and the second elastic element 15 is formed by multilayer overlapped rubber sheets. The rubber sheet itself has an excellent elasticity, and the buffering effect thereof is also excellent. Apparently, the elastomers may also be other materials which has an excellent elasticity, for example silica gel, nylon, etc.

For facilitating the connection of the coupler buffer and the vehicle body, the connecting shaft 17 may extend out of the rear end of the casing 14, and the extending portion is provided with threads, and the connecting shaft 17 is connected to the coupler yoke and the casing.

In such an arrangement, the coupler buffer can be connected to the vehicle body by the connecting shaft 17 and the nut on the connecting shaft 17, which is convenient and reliable.

For preventing the elastic component from being damaged under a tensile overload, based on the first embodiment, a coupler buffer according to a second embodiment of the present application further includes a reinforcing plate for a tensile overload protection. Reference is made to FIGS. 3 to 7, multiple reinforcing plates 10 are provided. Each of the reinforcing plates 10 is inserted into the first elastic component 13 in a direction perpendicular to the direction that the first elastic component 13 is compressed. The reinforcing plate 10 includes a main body portion 10*a* inserted into the first elastic component 13 and a protrusion 10*b* which is arranged at an edge of the main body portion and protrudes out of the main body portion. The protrusion 10*b* and the main body portion 10*a* form a groove for accommodating the first elastic component 13.

Figure 6:
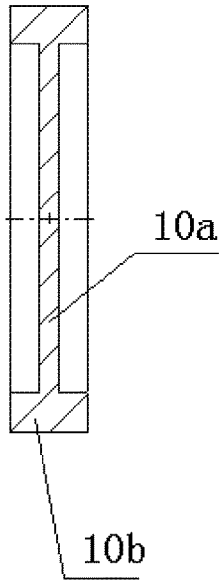
FIG. 6 is a sectional view of the reinforcing plate according to the second embodiment of the present application.
Figure 7:
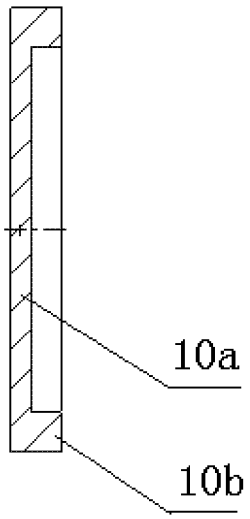
FIG. 7 is a sectional view of another reinforcing plate according to the second embodiment of the present application.
Figure 8:
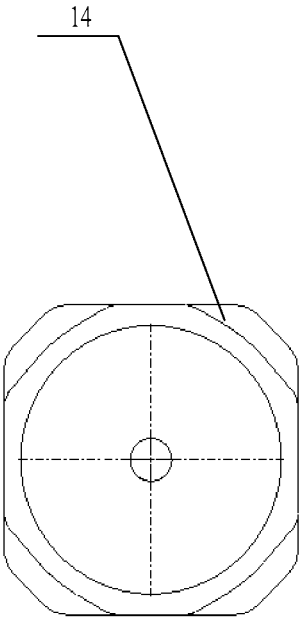
FIG. 8 is a schematic view showing a sectional view of a casing according to a third embodiment of the present application.
Figure 9:
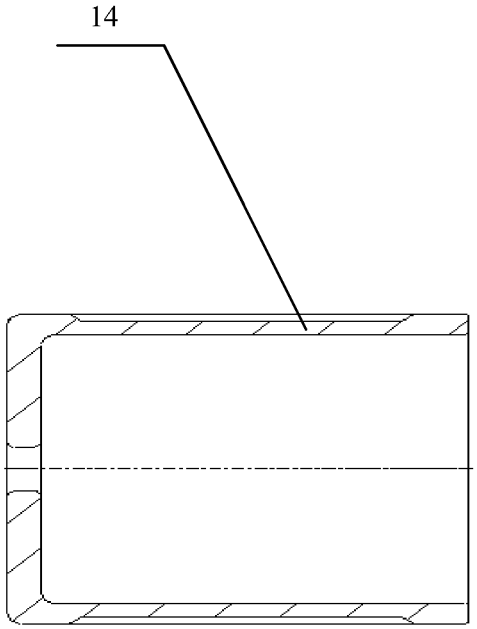
FIG. 9 is a schematic view showing a longitudinal section of the casing according to the third embodiment of the present application.
Figure 10:
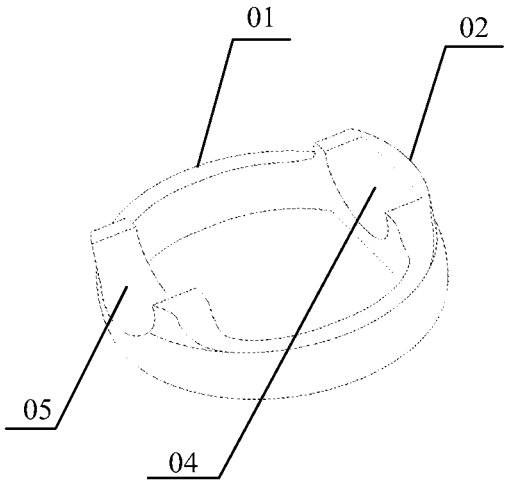
FIG. 10 is a perspective view of a rotating sleeve according to a fourth embodiment of the present application.
Figure 11:
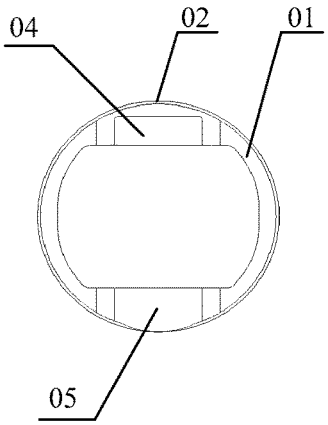
FIG. 11 is a top view of the rotating sleeve according to the fourth embodiment of the present application.
Figure 12:
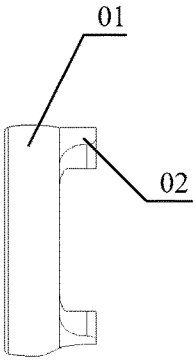
FIG. 12 is a side view of the rotating sleeve according to the fourth embodiment of the present application.
Figure 13:
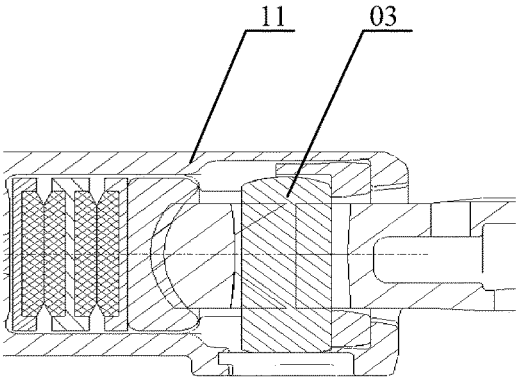
FIG. 13 is a schematic view showing that the rotating sleeve, according to the fourth embodiment of the present application, is assembled with a coupler tail pin.
Figure 14:
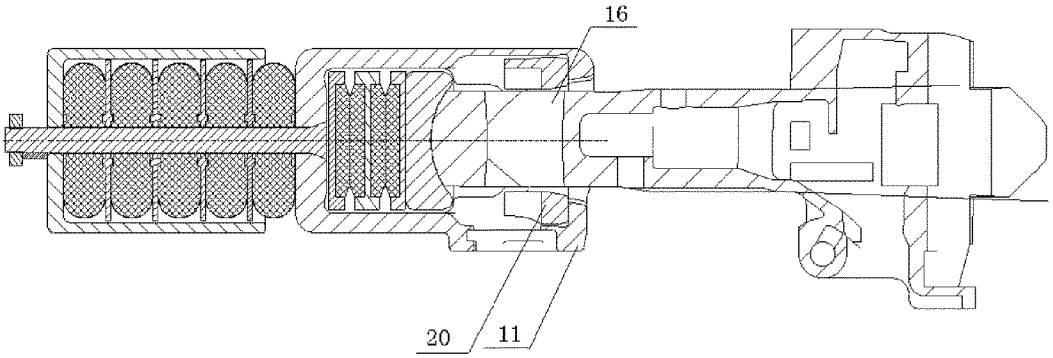
FIG. 14 is a schematic view showing the structure of a coupler buffer according to a fifth embodiment of the present application, which can be turned over.

It is to be noted that, in the reinforcing plate 10 according to this embodiment, the protrusion 10*b* may be provided at two surfaces of the main body portion 10*a*, as shown in FIG. 6. The protrusion 10*b* may alternatively be provided at one surface of the main body portion 10*a*, as shown in FIG. 7.

In the reinforcing plate 10 for tensile overload protection according to this embodiment, the protrusion 10*b*, which is inserted into the first elastic component, is provided all round the main body portion 10*a*, thus the protrusions 10*a* and the main body portion 10*b* form a groove for accommodating the first elastic component. In a case that the vehicle suffers a tensile force which excesses the ultimate load of the buffer, the first elastic component may be compressed under force. At the same time, the protrusions 10*b* of adjacent two reinforcing plates would abut against each other, and the first elastic component will not be compressed further, effectively protecting the first elastic component.

Further, for preventing the casing from being damaged under a compression overload, based on the above embodiment, in a coupler buffer according to a third embodiment of the present application, the casing of the coupler buffer can provide compression overload protection. Referring to FIGS. 3, 4, 8 and 9, the casing 14 is a cylindrical structure with an opening provided at one end, and the second elastic component of the coupler buffer is arranged in the casing 14, and a cross section of the casing 14 has an outer regular hexagonal edge and an inner circular edge.

The casing for compression overload protection according to this embodiment is a cylinder structure which has an opening at one end, and the second elastic element 15 of the buffer may be mounted into the casing via the opening. Since the cross section of the casing has the outer regular hexagonal edge and the inner circular edge, the casing with such a structure is capable of bearing a larger load in an axial direction than a casing having a circular outer edge and a circular inner edge or having a rectangular outer edge and a rectangular inner edge. Thus, when the compression load suffered by the vehicle excesses the ultimate load of the second elastic element 15, the casing can provide effective protection to the second elastic element 15 therein.

Specifically, in a case that the axial compression force suffered by the vehicle is greater than the ultimate load of the second elastic element 15, the coupler yoke 11 abuts against the casing 14. Since the casing 14 according to this embodiment has a higher strength, which cannot be crushed, thus the casing may further provide effective protection to the second elastic element 15 therein.

Further, based on the above embodiments, a coupler buffer is provided according to a fourth embodiment of the present application. The coupler buffer further includes a rotating sleeve. Referring to FIGS. 3, 4, 10 to 13, the rotating sleeve according to this embodiment includes a rotating ring portion 01 for being sleeved on an outer periphery of the coupler 16 and a mounting portion 02 for a coupler tail pin which is connected to an end of the rotating portion 01. An outer surface of the rotating portion 01, i.e., the surface that the rotating sleeve contacts with the coupler yoke 11, is a spherical surface.

In such an arrangement, when the rotating sleeve according to this embodiment is used, the coupler is nested in the rotating ring portion 01. The coupler tail pin 03, which is inserted into the coupler, is mounted to the mounting portion 02 for the coupler tail pin by a portion protruding out of the coupler, of the coupler tail pin 03, and is limited by the mounting portion 02 for the coupler tail pin. As the coupler rotates, the coupler tail pin 03 allows the rotating sleeve to be rotated.

In a case that the vehicle suffers a compression force, the coupler allows the rotating sleeve to slide in the coupler yoke 11 in an axial direction. Since the outer peripheral surface of the rotating portion 01 in the rotating sleeve according to this embodiment is a spherical surface, the contact between the rotating sleeve and the coupler yoke 11 is a line contact, thereby the friction between the rotating sleeve and the coupler yoke 11 is small, effectively avoiding wear problem of the rotating sleeve and the coupler yoke 11.

In addition, in the rotating sleeve according to this embodiment, the mounting portion 02 for the coupler tail pin of the rotating sleeve is connected to a position at one end of the rotating portion 01, and the rotating portion 01 has a small width, thus the overall weight of the rotating sleeve is small, which facilitates the lightness of the vehicle.

An inner side surface of a portion, in cooperation with the rotating sleeve, of the coupler yoke 11 is a circular peripheral surface, which facilitates the rotating of the rotating sleeve. In a preferred solution of this embodiment, an outer surface of the mounting portion 02 for the coupler tail pin of the rotating sleeve, i.e., the surface close to the inner side surface of the coupler yoke 11 is a cylindrical surface which is matched with the inner side surface of the coupler yoke 11. In such an arrangement, the whole rotating sleeve may be mounted conveniently into the coupler yoke 11 from one end of the coupler yoke 11, and the mounting portion 02 for the coupler tail pin would not affect the assembly of the rotating sleeve.

In another preferred solution of this embodiment, a mounting portion 02 for a coupler tail pin includes a first half annular groove 04 matching with one end of the coupler tail pin 03, and a second half annular groove 05 matching with another end of the coupler tail pin 03.

In such an arrangement, when the coupler is assembled to the coupler yoke 11, it simply requires: first, the rotating sleeve is mounted into the coupler yoke 11, then the coupler, in which a coupler tail pin 03 is inserted, is further inserted into the coupler yoke 11, and two ends of the coupler tail pin 03 are allow to fall into the first half annular groove 04 and the second half annular groove 05. Since both of the first haft annular groove 04 and the second half annular groove 05 are open grooves, the coupler tail pin 03 may be conveniently fall into the first half annular groove 04 and the second half annular groove 05. In addition, each of inner side surfaces of the first half annular groove 04 and the second half annular groove 05 is a cylindrical surface, thus the contact area between the coupler tail pin 03 and the inner side surfaces is relatively large, which avoids a contact stress and further avoids the coupler tail pin 03 or the rotating sleeve being worn.

For avoiding the coupler tail pin 03 moving along the axial direction freely and further disengaging from the coupler, in this embodiment, the second haft annular groove 05 is provided with a bottom portion for abutting against the coupler tail pin 03. In such an arrangement, the bottom portion of the second half annular groove 05 abuts against the coupler tail pin 03, thus avoiding the coupler tail pin 03 moving freely along the axial direction.

A railway vehicle is provided according to a fifth embodiment of the present application, which includes the coupler buffer according to the first embodiment.

It is to be noted that, in some operating conditions, the vehicle may give an impact to the coupler and further cause the coupler to turn over. For avoiding a rigidity impact to the coupler, in another preferred solution of this embodiment, referring to FIG. 14, a rotating sleeve 20 is sleeved on a portion, inserting into the coupler yoke 11, of the coupler 16, and the rotating sleeve 20 is rotatably fixed into the coupler yoke 11.

In such an arrangement, the coupler buffer according to this embodiment may be rotated by 360 degree without being disengaged from the coupler, thus avoiding a rigid impact to the coupler caused by the vehicle.

A coupler buffer and a railway vehicle according to the present application are described in detail hereinbefore. The principle and the embodiments of the present application are illustrated herein by specific examples. The above description of examples is only intended to facilitate the understanding of the method and concept of the present application. It should be noted that, for the person skilled in the art, many modifications and improvements may be made to the present application without departing from the principle of the present application, and these modifications and improvements are also deemed to fall into the protection scope of the present application defined by the claims.

What is claimed is:

1. A coupler buffer, comprising:

a coupler yoke for connection to a coupler, a front stop body for mounting to a vehicle body, a first elastic element, wherein a rear end of the first elastic element abuts against the coupler yoke and a front end of the first elastic element abuts against the front stop body, and in a case that the vehicle body suffers a traction force, the first elastic element is compressed under force, a casing arranged at a rear end of the coupler yoke, wherein a rear end of the casing is configured to be connected to the vehicle body, and the casing is connected to the coupler yoke via a connecting shaft, and the coupler yoke is movable along an axial direction of the connecting shaft, and a second elastic element arranged between the casing and the coupler yoke, wherein in a case that the vehicle body suffers a compression force, the second elastic element is compressed under force, wherein the coupler buffer further comprises a rotating sleeve, the rotating sleeve comprises a rotating ring portion configured to be sleeved on an outer periphery of the coupler and a mounting portion for a coupler tail pin which is connected to an end of the rotating ring portion, and an outer surface of the rotating ring portion is a spherical surface, wherein an outer surface of the mounting portion for the coupler tail pin is a cylindrical surface which is matched with an inner side surface of the coupler yoke.

2. The coupler buffer according to claim 1, wherein a follower is provided in the coupler yoke, and a front end of the first elastic element abuts against the front stop body via the follower, and the follower abuts against a tail end of the coupler.

3. The coupler buffer according to claim 2, wherein the follower, the first elastic element, the coupler yoke, the second elastic element and the casing are connected in series on the connecting shaft.

4. The coupler buffer according to claim 2, wherein the follower is provided with an arched groove on a surface corresponding.

5. The coupler buffer according to claim 1, further comprising a rear stop body which is mounted to the vehicle body and abuts against the rear end of the casing.

6. The coupler buffer according to claim 3, wherein each of the first elastic element and the second elastic element comprises a multilayer of overlapped elastomers.

7. The coupler buffer according to claim 6, wherein each of the overlapped elastomers is a rubber sheet.

8. The coupler buffer according to claim 3, wherein the connecting shaft extends out of the rear end of the casing, and the extended portion is provided with threads, and the connecting shaft is connected to the coupler yoke and the casing.

9. The coupler buffer according to claim 4, wherein a rotating sleeve is sleeved on a portion, inserted into the coupler yoke, of the coupler, and the rotating sleeve is rotatably fixed into the coupler yoke.

10. The coupler buffer according to claim 1, comprising a reinforcing plate for a tensile overload protection, wherein a plurality of the reinforcing plates is provided, and each of the reinforcing plates is inserted into the first elastic element a direction perpendicular to the direction that the first elastic element is compressed, the reinforcing plate comprises a main body portion inserted into the first elastic element and a protrusion which is arranged at an edge of the main body portion and protrudes out of the main body portion, and the protrusion and the main body portion form a groove for accommodating the first elastic element.

11. The coupler buffer according to claim 1, wherein the casing is provided for compression overload protection, the casing is a cylindrical structure with an opening provided at one end, and the second elastic element of the coupler buffer is arranged in the casing, and a cross section of the casing has an outer regular hexagonal edge and an inner circular edge.

12. The coupler buffer according to claim 1, wherein the mounting portion for the coupler tail pin comprises a first half annular groove matching with one end of the coupler tail pin and a second half annular groove matching with another end of the coupler tail pin.

13. The rotating sleeve according to claim 12, wherein the second half annular groove is provided with a bottom portion which abuts against the coupler tail pin.

14. A railway vehicle, comprising a coupler buffer comprising:

a coupler yoke for connection to a coupler, a front stop body for mounting to a vehicle body, a first elastic element, wherein a rear end of the first elastic element abuts against the coupler yoke and a front end first elastic element abuts against the front stop body, and in a case that the vehicle body suffers a traction force, the first elastic element is compressed under force, a casing arranged at a rear end of the coupler yoke, wherein a rear end of the casing is configured to be connected to the vehicle body, and the casing is connected to the coupler yoke via a connecting shaft, and the coupler yoke is movable along an axial direction of the connecting shaft, and a second elastic element arranged between the casing and the coupler yoke, wherein in a case that the vehicle body suffers a compression force, the second elastic element is compressed under force, wherein the coupler buffer further comprises a rotating sleeve, the rotating sleeve comprises a rotating ring portion configured to be sleeved on an outer periphery of the coupler and a mounting portion for a coupler tail pin which is connected to an end of the rotating ring portion, and an outer surface of the rotating ring portion is a spherical surface, and wherein an outer surface of the mounting portion for the coupler tail pin is a cylindrical surface which is matched with an inner side surface of the coupler yoke.

15. The coupler buffer according to claim 2, comprising a reinforcing plate for a tensile overload protection, wherein a plurality of the reinforcing plates is provided, and each of the reinforcing plates is inserted into the first elastic element in a direction perpendicular to the direction that the first elastic element is compressed, the reinforcing plate comprises a main body portion inserted into the first elastic element and a protrusion which is arranged at an edge of the main body portion and protrudes out of the main body portion, and the protrusion and the main body portion form a groove for accommodating the first elastic element.

16. The coupler buffer according to claim 2, wherein the casing is provided for compression overload protection, the casing is a cylindrical structure with an opening provided at one end, and the second elastic element of the coupler buffer is arranged in the casing, and a cross section of the casing has an outer regular hexagonal edge and an inner circular edge.

17. A railway vehicle according to claim 14, wherein a follower is provided in the coupler yoke, and a front end of the first elastic element abuts against the front stop body via the follower, and the follower abuts against a tail end of the coupler.

* * * * *